US006465971B1

(12) United States Patent
Parra

(10) Patent No.: US 6,465,971 B1
(45) Date of Patent: Oct. 15, 2002

(54) PLASTIC "TROFER" AND FLUORESCENT LIGHTING SYSTEM

(76) Inventor: Jorge M. Parra, 10721 Skyhawk Dr., New Port Richey, FL (US) 34654

( * ) Notice: Subject to any disclaimer, the term of this patent is extended or adjusted under 35 U.S.C. 154(b) by 0 days.

(21) Appl. No.: 09/580,950

(22) Filed: May 30, 2000

Related U.S. Application Data

(60) Provisional application No. 60/137,508, filed on Jun. 2, 1999.

(51) Int. Cl.[7] ..... H05B 37/02

(52) U.S. Cl. ..... 315/209 R; 315/246; 315/312; 315/DIG. 7; 362/362; 362/378; 362/265

(58) Field of Search ..... 315/209 R, 246, 315/244, 312, DIG. 7; 362/362, 378, 255, 222, 223, 265

(56) References Cited

U.S. PATENT DOCUMENTS

| | | | | | |
|---|---|---|---|---|---|
| 1,963,963 | A | | 6/1934 | Barclay | 176/124 |
| 2,139,815 | A | | 12/1938 | Fodor | 40/130 |
| 3,235,771 | A | * | 2/1966 | Schwartz | 315/312 |
| 3,801,865 | A | * | 4/1974 | Roberts | 315/276 |
| 3,975,660 | A | | 8/1976 | Knobel et al. | 315/102 |
| 4,005,330 | A | | 1/1977 | Glascock, Jr. et al. | 315/57 |
| 4,010,400 | A | | 3/1977 | Hollister | 315/248 |
| 4,172,981 | A | | 10/1979 | Smith | 307/66 |
| 4,189,661 | A | | 2/1980 | Haugsjaa et al. | 315/39 |
| 4,196,374 | A | | 4/1980 | Witting | 315/58 |
| 4,266,167 | A | | 5/1981 | Proud et al. | 315/248 |
| 4,373,146 | A | | 2/1983 | Bonazoli et al. | 315/209 R |
| 4,410,930 | A | | 10/1983 | Yachabach | 362/145 |
| 4,420,898 | A | | 12/1983 | Moses | 40/570 |
| 4,427,923 | A | | 1/1984 | Proud et al. | 315/248 |
| 4,461,981 | A | * | 7/1984 | Saikatsu et al. | 315/248 |
| 4,482,809 | A | | 11/1984 | Maarschalkerweerd | 250/436 |
| 4,544,863 | A | * | 10/1985 | Hashimoto | 315/209 R |
| 4,587,600 | A | | 5/1986 | Morten | 362/219 |
| 4,613,795 | A | * | 9/1986 | Itani et al. | 315/205 |
| 4,630,005 | A | | 12/1986 | Clegg et al. | 331/113 A |
| 4,650,265 | A | | 3/1987 | Holtzman | 339/1 L |
| 4,782,268 | A | | 11/1988 | Fähnrich et al. | 315/200 R |
| 4,798,997 | A | | 1/1989 | Egami et al. | 315/115 |
| 4,808,887 | A | | 2/1989 | Fähnrich et al. | 315/247 |
| 4,857,806 | A | | 8/1989 | Nilssen | 315/72 |
| RE33,057 | E | | 9/1989 | Clegg et al. | 315/224 |
| 4,872,980 | A | | 10/1989 | Maarschalkerweerd | 250/243 |

(List continued on next page.)

OTHER PUBLICATIONS

Peter N. Wood and Gerry Limjuco, "Simple Electronic Ballast Using IR2155 MOS Gate Driver", *International Rectifier Publication Application Notes*, No. DT 94–3, pp. 1–11. (Best available copy).

Peter N. Wood, "Electronic Ballasts Using the Cost–Saving IR2155 Driver", *International Rectifier Publication Application Notes*, No. AN–995, pp. 1–3.

*Primary Examiner*—Haissa Philogene
(74) *Attorney, Agent, or Firm*—Jim Zegeer

(57) ABSTRACT

A fluorescent lighting system having a low-cost nonconductive plastic housing and a plurality of fluorescent lighting tubes carried in sockets in the housing and a square-wave alternating current source connected to drive the fluorescent lighting tubes.

3 Claims, 3 Drawing Sheets

U.S. PATENT DOCUMENTS 4,920,299 A 4/1990 Presz et al. ..... 315/98
4,949,013 A 8/1990 Zuchtriegel ..... 315/106
4,959,591 A 9/1990 Hirschmann ..... 315/209 R
4,973,885 A 11/1990 Kerwin ..... 315/219
5,023,518 A 6/1991 Mans et al. ..... 315/219
5,023,519 A * 6/1991 Jensen ..... 315/242
5,043,627 A * 8/1991 Fox ..... 313/491
5,081,399 A 1/1992 Jy ..... 315/121
5,140,224 A * 8/1992 Kakitani et al. ..... 315/209 R
5,204,586 A * 4/1993 Moore ..... 315/159
5,230,792 A 7/1993 Sauska et al. ..... 210/97
5,300,860 A 4/1994 Godyak et al. ..... 315/39
5,324,423 A 6/1994 Markham ..... 210/87
5,325,024 A 6/1994 Piejak et al. ..... 315/248
5,349,270 A 9/1994 Roll et al. ..... 315/209 R
5,359,263 A 10/1994 Roberts ..... 315/58
5,365,145 A * 11/1994 Fields ..... 315/86
5,381,073 A 1/1995 Godyak et al. ..... 315/58
5,401,394 A 3/1995 Markham ..... 210/85
5,408,162 A 4/1995 Williams ..... 315/224
5,461,286 A 10/1995 Hirschmann ..... 315/205
5,491,387 A * 2/1996 Saito ..... 315/307
5,503,800 A 4/1996 Free ..... 422/24
5,512,801 A 4/1996 Nilssen ..... 315/209 R
5,521,467 A 5/1996 Statnic et al. ..... 315/247
5,526,251 A 6/1996 Andre et al. ..... 362/396
5,536,395 A 7/1996 Kuennen et al. ..... 210/87
5,547,590 A 8/1996 Szabo ..... 210/748
5,548,189 A 8/1996 Williams ..... 315/224
5,578,907 A 11/1996 Tao et al. ..... 315/247
5,581,161 A 12/1996 Gong ..... 315/307
5,611,163 A * 3/1997 Smith ..... 362/456 X
5,611,918 A 3/1997 Markham ..... 210/87
5,640,069 A * 6/1997 Nilssen ..... 315/209 R
5,656,925 A * 8/1997 Schie et al. ..... 323/222
5,666,031 A * 9/1997 Jennato et al. ..... 315/246
5,677,602 A * 10/1997 Paul et al. ..... 315/224
5,698,091 A 12/1997 Kuennen et al. ..... 210/87
5,707,594 A 1/1998 Austin ..... 422/186.3
5,710,487 A * 1/1998 Valcke ..... 315/205
5,757,144 A * 5/1998 Nilssen ..... 315/291
5,866,984 A 2/1999 Doughty et al. ..... 313/643
5,905,339 A * 5/1999 Chow et al. ..... 313/631
5,914,571 A * 6/1999 Beasley ..... 315/244
5,914,843 A * 6/1999 Hopkins et al. ..... 361/42
6,135,620 A * 10/2000 Marsh ..... 362/377

* cited by examiner

PLASTIC "TROFER" AND FLUORESCENT LIGHTING SYSTEM

REFERENCE TO RELATED APPLICATION

The present application is based on Provisional Application No. 60/137,508 filed Jun. 2, 1999 entitled PLASTIC "TROFER" FOR FLUORESCENT LIGHTING.

Reference is made to application Ser. No. 08/942,670 filed Oct. 2, 1997 entitled LOW VOLTAGE NON-THERMIONIC BALLAST-FREE FLUORESCENT LIGHT SYSTEM AND METHOD and U.S. Pat. No. 6,034,485 which are incorporated herein by reference.

BACKGROUND AND BRIEF DESCRIPTION OF THE INVENTION

A fluorescent lighting fixture housing includes a space for housing a ballast transformer, a metal reflector, tube socket members and wiring between the ballast transformer and the tube sockets. Conventionally, these housings (commonly called "trofers" because they hold 2–4 fluorescent tubes) have been made out of sheet metal to convey heat generated by conventional heating of the filaments, ballast transformers and the heating from the plasma in the gas. This heating requires that the fixture be spaced from wood and other flammable structures using, in many cases, chains, hooks, etc., which suspend the fluorescent fixture from a ceiling, for example, which also allows cooling air to circulate and cool the fixture. In addition, these prior art fixtures require the use of heat resistant wire. Moreover, in most cases a metal housing is required to be conductive so as to provide an electrical ground to avoid shock hazards due to high voltage.

For the following reasons a standard fluorescent fixture should have ground:

1. A grounded metal housing of a predetermined size and gauge acts as a "heat sink" for the ballast.
2. A grounded metal reflector with the lamps installed within about ½" of the reflector.
3. The ballast must be an integral part of the fixture.
4. The wiring in the fixture must be of at least #12 gauge and covered with high temperature insulation (over 95° C.).
5. The inner space between the "drop ceiling" and the structural ceiling must be ample enough to dissipate the heat from the fixture (from 2' to 3' average).
6. Power to the fixture must be supplied by a 3-wire system, 12 gauge or better, with a ground (bonded).
7. The metal fixture should have enough area of contact with the air to dissipate the heat.
8. Standard systems are "ground plane systems."

An object of the present invention is to provide a fluorescent lighting fixture and system which has a housing made of plastic.

Another object of the invention is to provide a fluorescent lighting fixture of the "trofer" type which is significantly cooler and as a result may be safely mounted directly on a ceiling.

Still another object of the invention is to provide a fluorescent lighting fixture and system which is ballast-free, significantly cooler in operation than prior art fixtures, and a fluorescent lighting fixture which is significantly less hazardous and thus safer from fire and high-voltage hazards.

Another object of the invention is to provide a lighting fixture of the trofer type which is shallow and of less volume than prior art trofers.

DESCRIPTION OF THE INVENTION

A fluorescent lighting fixture includes a plastic or non-conductive housing, preferably made of a thermoplastic resin, sockets for fluorescent tubes and an alternating current square-wave alternating voltage source (sometimes hereinafter called "square-wave driver" or "driver") for driving the fluorescent tubes. In one embodiment, the square-wave driver is thin (not requiring a large heavy ballast transformer) and can be mounted by screws or an adhesive on the housing or carried in a slot molded or formed in the non-conductive housing. In another embodiment, since the driver is small and does not require a ballast transformer, it can be mounted in a light switch housing. In this case, since the current and voltage levels are low due to the improved efficiency of driving the fluorescent lamps or tubes with the high frequency alternating square waves supplied by the driver as described in my above-identified application, smaller gauge wires and less insulation can, if desired, be used. A conventional light diffuser may be mounted in the housing to diffuse the light from the lamps.

Features of a Plastic Fixture (Trofer), Driver and Lamp Array According to the Invention 1. Lamps can be driven by individual drivers, i.e. integral to the sockets or integral to the lamp. Or the lamps can be connected in series to the appropriate capacity driver in any numbers, odd or even.
2. The driver could be integral to the fixture or can be non-integral, mounted on a remote location, i.e. the switch assembly.
3. No grounded metal reflector is needed.
4. No clearance from combustible materials needed.
5. No heat release area between the finish ceiling and the structural ceiling needed.
6. No bonded ground is needed, no "ground wire."
7. No reinforcing of the finish ceiling is needed, due to low weight.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
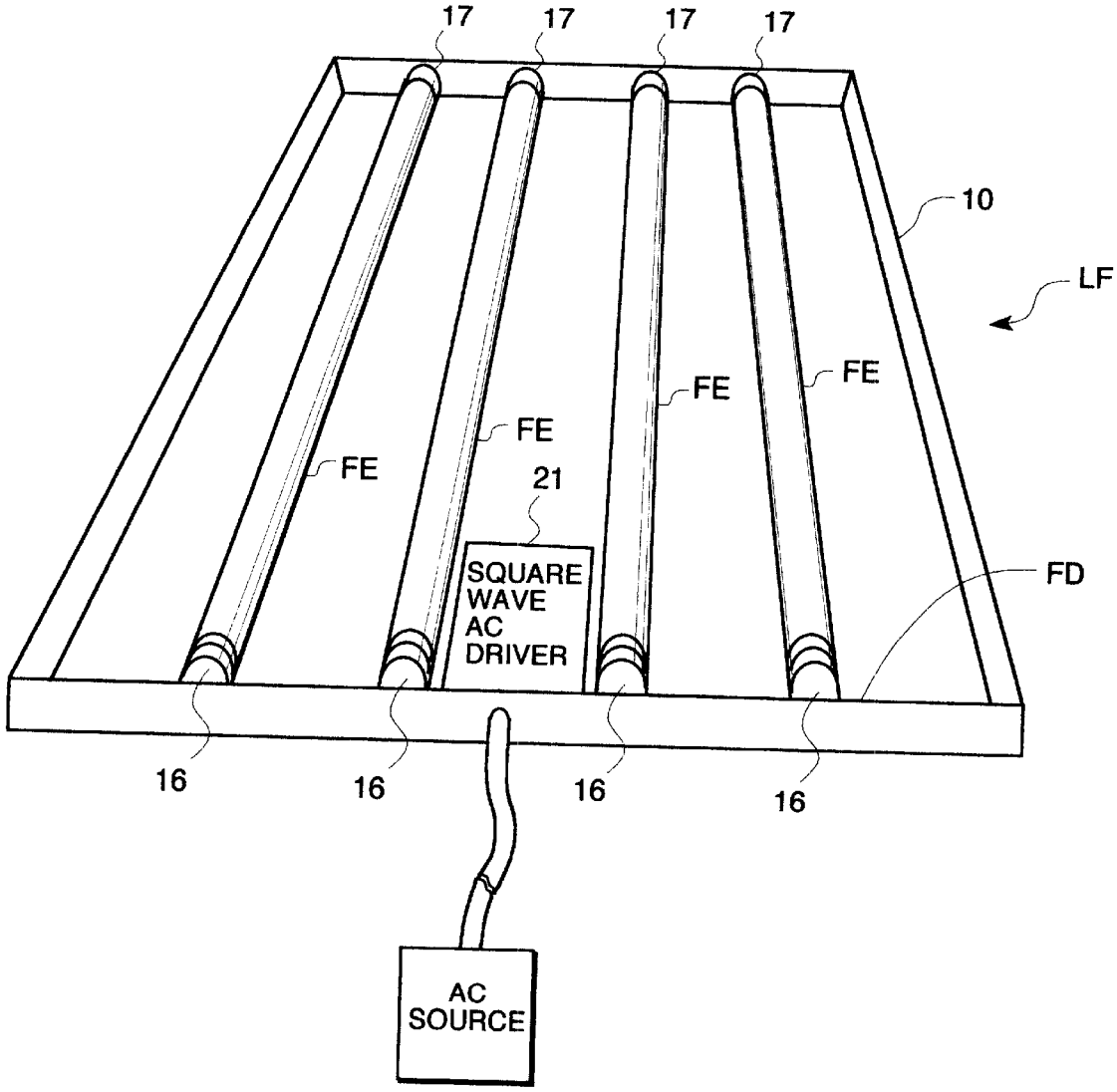
FIG. 1 is a diagrammatic illustration of a fluorescent lighting fixture (trofer) incorporating the invention.
Figure 2A:
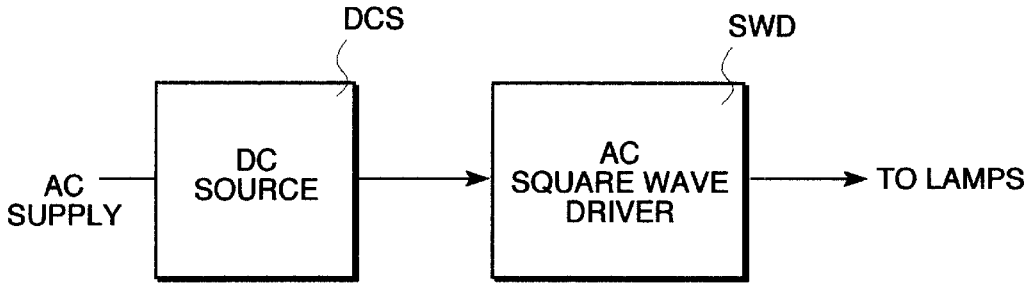
FIGS. 2A–2C are block diagrams illustrating different embodiments of the invention.
Figure 2B:
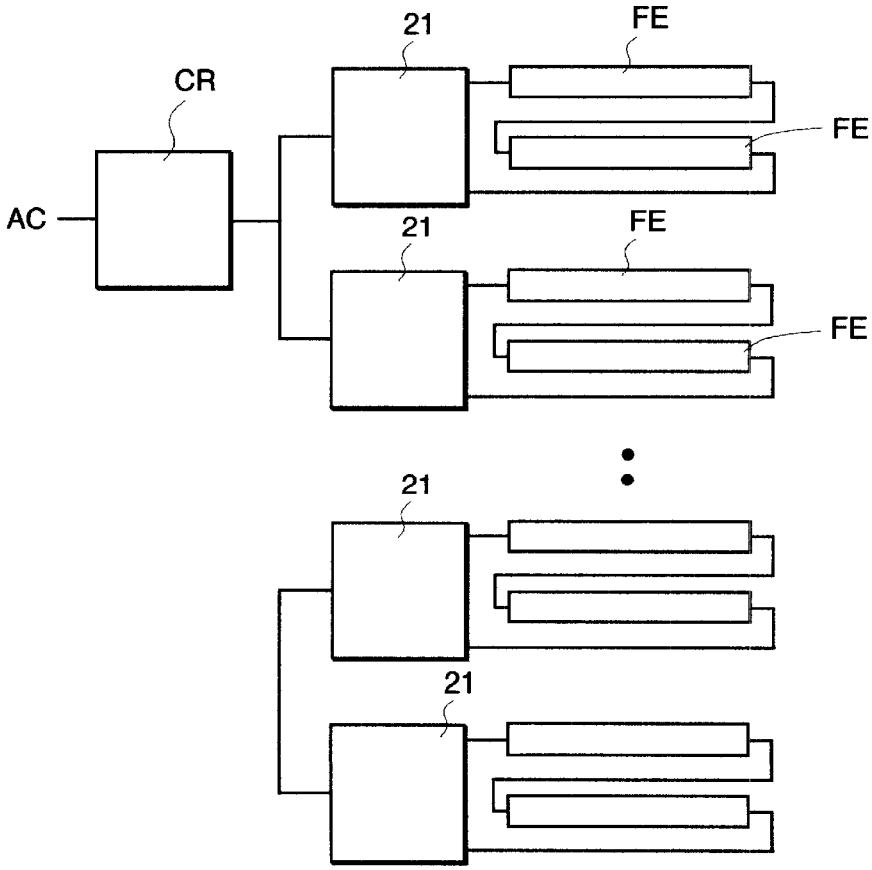
Figure 2C:
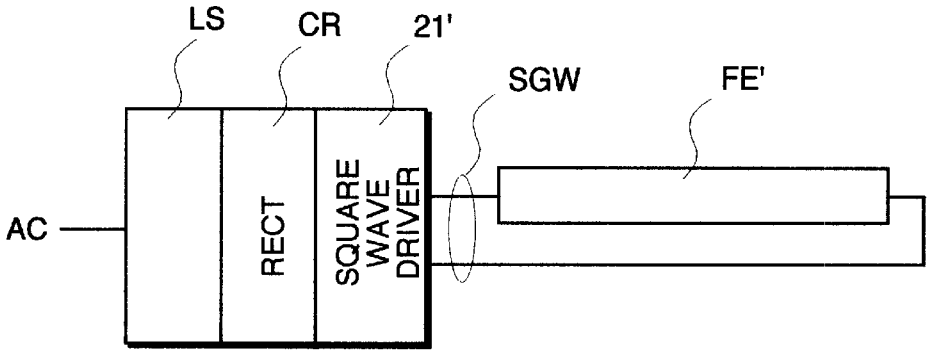

Referring to FIG. 1, a fluorescent lighting fixture LF includes a plastic or non-conductive housing 10, preferably made of a thermoplastic resin, bi-pin sockets 16–17 for fluorescent tubes and an alternating current square-wave alternating voltage source 21 (sometimes hereinafter called "square-wave driver" or "driver" for driving the fluorescent tubes FE. The basic circuit block diagram is shown in FIG. 2A and includes a DC supply or source DCS and an AC square-wave driver SWD for driving one or more lamps. The square-wave driver circuit may incorporate a rectifier, or a common rectifier CR connected to an AC source may supply a plurality of drivers 21 (FIG. 2B). In one embodiment, the square-wave driver is thin (not requiring a large heavy ballast transformer) and can be mounted by screws or an adhesive on the housing or carried in a slot molded in the non-conductive housing. In another embodiment, since the driver is small and does not require a ballast transformer, it can be mounted in a light switch LS housing (FIG. 2C). In this case, since the current and voltage levels are low due to the improved efficiency of driving the fluorescent lamps or tubes with the high frequency alternating square waves supplied by the driver as described in my above-identified application, smaller gauge wires SGW and less insulation can, if desired, be used. A conventional light diffuser LD may be mounted in the housing to diffuse the light from the lamps.

While the invention has been described in relation to preferred embodiments of the invention, it will be appreciated that other embodiments, adaptations and modifications of the invention will be apparent to those skilled in the art.

What is claimed is:

1. In a fluorescent lighting system having a trofer housing and a plurality of fluorescent lighting tubes carried in sockets in said housing, the improvement comprising: a square-wave alternating current source connected to directly drive at least a pair of said fluorescent lighting tubes in series and wherein said trofer housing is made of a low-cost non-conductive plastic material.

2. A fluorescent lighting fixture comprising in combination:

a non-conductive plastic trofer housing having an integral reflector thereon and a plurality of fluorescent light tube sockets, and at least one fluorescent light-producing tube mounted in said tube sockets, a driver circuit connected to said fluorescent light tube sockets, said driver circuit including:

a source of direct current, a square-wave alternating voltage generator connected to said source of direct current for generating an alternating current square-wave and means connecting said alternating current square-wave directly to said fluorescent light tube sockets.

3. In a fluorescent lighting system having a trofer housing and a plurality of fluorescent lighting tubes carried in sockets in said housing, the improvement comprising: a high-frequency, square-wave alternating current source connected to drive at least a pair of said fluorescent lighting tubes in series and wherein said trofer housing is made of a low-cost non-conductive plastic material.

* * * * *